United States Patent [19]

Sturm et al.

[11] Patent Number: 4,801,151

[45] **Date of Patent: * Jan. 31, 1989**

[54] ARROW STRING TRACKING APPARATUS

[75] Inventors: Michael O. Sturm, 552 Country Club Blvd., Des Moines, Iowa 50312; Frank A. Mika, Potomac, Md.

[73] Assignee: Michael O. Sturm, Des Moines, Iowa

[ * ] Notice: The portion of the term of this patent subsequent to Mar. 24, 2004 has been disclaimed.

[21] Appl. No.: 27,860

[22] Filed: Mar. 19, 1987

Related U.S. Application Data

[63] Continuation-in-part of Ser. No. 886,804, Jul. 18, 1986, Pat. No. 4,651,999.

[51] Int. Cl.[4] ..... F41B 5/02

[52] U.S. Cl. ..... 273/416

[58] Field of Search ..... 273/416, 418–422; 89/1.34; 102/504; 43/6

[56] References Cited

U.S. PATENT DOCUMENTS

| | | | |
|---|---|---|---|
| 3,417,994 | 12/1968 | Rohrbaugh, Jr. | 273/418 |
| 3,993,311 | 11/1976 | Johnson | 273/420 |
| 4,212,463 | 7/1980 | Repinski et al. | 273/422 X |
| 4,252,325 | 2/1981 | Weems et al. | 273/416 |
| 4,309,974 | 1/1982 | Carter et al. | 124/23 R |
| 4,651,999 | 3/1987 | Sturm | 273/416 |

OTHER PUBLICATIONS

BSI 1986–87 Catalog, BSI, 1158–46th Street, P.O. Box 5010, Vienna, W. Va., 26105–0010.

Tag–N–Trail Product, Flex–Fletch Products, 1840 Chandler Ave., St. Paul, Minn., 55113.

Shaft Spider Tracking Arrow Kit Product.

Tag–N–Trail Product, Dodge Plastics, Route, 3, Menomonie, Wis. 54751.

1986 Saunders Successories Catalog, p. 9, "Arrow Penetration Limiter".

*Primary Examiner*—Paul E. Shapiro

*Attorney, Agent, or Firm*—Henderson & Sturm

[57] ABSTRACT

A string tracking apparatus for archery arrows including an arrow having a hollow tubular shaft with a point attached to one end of the shaft. A nock is attached to the other end of the shaft and fletching is disposed near the nock for stabilizing the arrow in flight. A coil of flexible line is disposed within the hollow shaft. A hook-shaped catching structure is attached to the other end of the flexible line. The hook-shaped catching device is frictionally disposed around the front end of the shaft or around the front end of the point attached to the shaft.

5 Claims, 2 Drawing Sheets

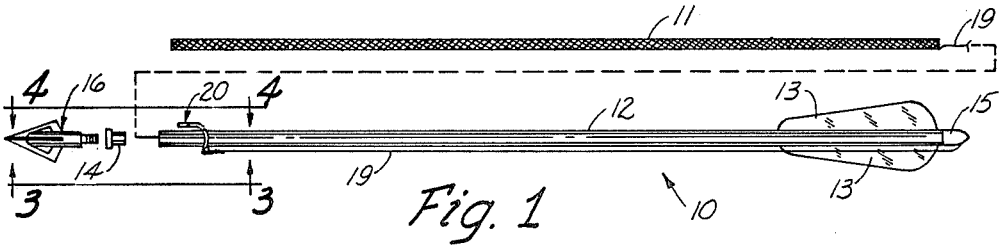
Fig. 1
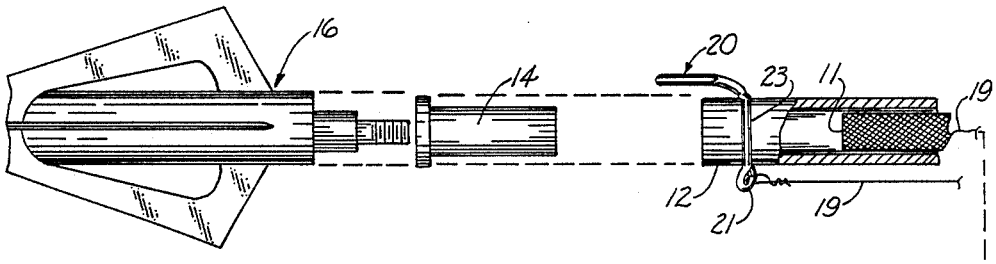
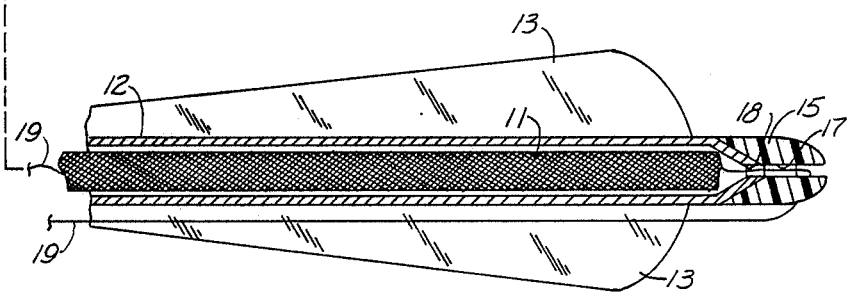
Fig. 2
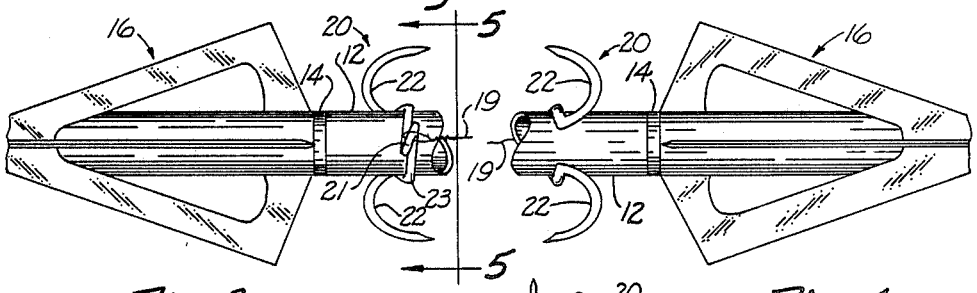
Fig. 3
Fig. 4
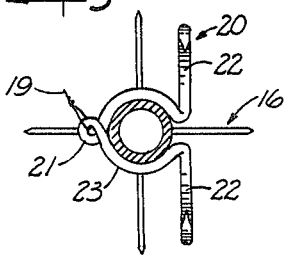
Fig. 5

ARROW STRING TRACKING APPARATUS

CROSS REFERENCE TO RELATED APPLICATION

This application is a continuation-in-part of U.S. patent application Ser. No. 886,804 filed July 18, 1986, now U.S. Pat. No. 4,651,999, which is incorporated herein by reference.

TECHNICAL FIELD

This present invention relates generally to archery, and more particularly to string tracking devices for enabling a bow hunter to follow string to the game hit with an arrow.

BACKGROUND ART

One of the problems with bow hunting is tracking down the game after it has been shot. When a bow hunter hits a mammal such as deer or elk with a well placed arrow, the animal can be easily tracked down by following a blood trail, unless it is raining or snowing or for some other reason the blood trail is covered up quickly. Tracking for turkeys or other birds is not so simple because they do not leave a well defined blood trail regardless of how well they are hit. Furthermore, in the case of turkeys, it is very common for the arrow to pass completely through the turkey. While this happens quite often with deer or elk hunting, it almost always happens while turkey hunting unless the arrow has been modified to prevent it from doing so. Accordingly, there is a problem sometimes in finding game which does not leave a well defined blood trail.

The aforementioned problem has been solved to some degree by using string tracking devices which have a spool of string attached to the bow with the other end of the string attached to the arrow. When the arrow is shot, the string unwinds from the spool attached to the bow, and then the string can be followed from the spool to the arrow to find the game. A problem with these devices is that they tend to slow down the speed of the arrow, sometimes causing the archer to shoot low. A further problem with prior art string tracking devices is that they tend to be somewhat cumbersome and the string sometimes catches on brush or the like and unwinds from the spool, thereby rendering them inoperative until the string is rewound so that there is no excess string dragging on the ground or onto bushes or the like.

Similar structures have been used for bow fishing wherein a reel, such as that used in fishing, has a line thereon which is attached to an arrow. Then when the arrow is shot, the string unwinds from the reel and then the fish can be reeled in by pulling the arrow back to the bow, which is attached to the reel. This system works well for bow fishing, but does not work very well for bow hunting for turkeys or large mammals.

Accordingly, there is a need for string tracking devices which do not have the aforementioned problems associated therewith.

DISCLOSURE OF THE INVENTION

The present invention relates generally to a string tracking apparatus for archery arrows including an arrow having a hollow tubular shaft with a point attached to one end of the shaft. A nock is attached to the other end of the shaft and fletching is disposed near the nock for stabilizing the arrow in flight. A coil of flexible line is disposed within the hollow shaft. A hook-shaped catching device is frictionally disposed around the front end of the shaft or around the front end of the point attached to the shaft. When the arrow is shot through an object, such as a turkey, the hook-shaped catching device will not pass through the object although the arrow may very well pass therethrough. If it is a turkey that the arrow has passed through, then the hook-shaped catching device will be attached to the turkey and the arrow will be sticking into the ground or laying on the ground. When the turkey runs away, the string within the shaft will unwind so that the hunter can find the turkey by following the flexible line. The catching device is designed to pop off of the arrow upon impact with an animal or bird so that if the arrow does not pass through the animal or bird, the hook-shaped catching device will catch on a weed, bush, tree or the like as the animal or bird runs away, thereby causing the string inside the arrow to unwind, leaving a trail from the catching device to the arrow.

An object of the present invention is to provide an improved string tracking apparatus for bow hunting.

Another object of the present invention is to provide a string tracking apparatus which is self-contained to an arrow and need not be attached to an archery bow.

Other objects, advantages and novel features of the present invention will become apparent from the following detailed description of the invention when considered in conjunction with the accompanying drawings.

BRIEF DESCRIPTION OF THE DRAWINGS

FIG. 1 is an exploded side view of an arrow string tracking apparatus constructed in accordance with the present invention;

FIG. 2 is an enlarged, exploded, partial cross-sectional view of the preferred embodiment of the present invention;

FIG. 3 is a view taken along line 3—3 of FIG. 1 and showing an enlarged assembled view of the tip end of the apparatus of FIG. 1;

FIG. 4 is a view taken along line 4—4 of FIG. 1 showing the opposite side of a catching device snapped onto the arrow shaft;

FIG. 5 is a cross-sectional view taken along line 5—5 of FIG. 3;

BEST MODES FOR CARRYING OUT THE INVENTION

Figure 6:
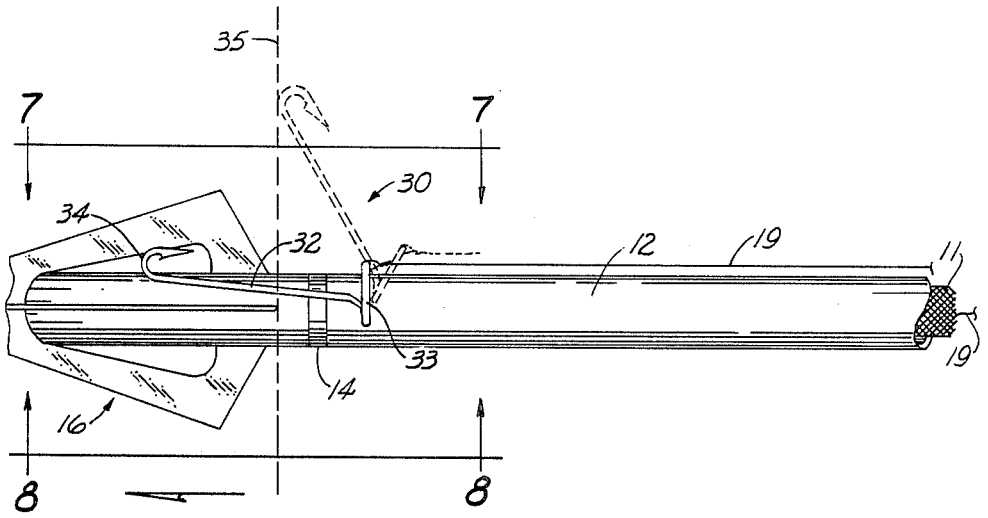
FIG. 6 shows an alternate embodiment of a catching device snapped onto the front end of an arrow and shows how the catching device snaps off of the arrow shaft when it comes in contact with an object represented by dashed lines in FIG. 6.

Referring now to the drawings wherein like reference numerals designate identical or corresponding parts throughout the several views, FIG. 1 shows an arrow string tracking apparatus (10) constructed in accordance with the present invention.

The apparatus (10) includes a hollow shaft (12) which may be constructed of aluminum or fiberglass, for example, and having feathers or plastic fletchings (13) glued to one end thereof. A plastic nock (16) is glued to one end of the shaft (12) and an internally threaded insert (14) and a broadhead (16) are adapted to be attached to the other end of the shaft (12).

A pencil-like spool of string (11) is wound upon itself as taught in U.S. Pat. No. 4,309,974, so that the end (19) thereof will unwind from the center of the spool (11). This will allow unwinding to occur without the string portion (19) contacting the inside of the shaft (12), as would be the case if the other end of the spool (11) were to extend out through the opening (17) of the nock (15) or through the opening (18) in the end of the shaft (12).

A catching device (20) has the extreme end of the string (19) of spool (11) tied thereto as can readily be seen in FIGS. 1 and 2. To assemble the arrow string tracking apparatus (10) of FIG. 1, the pencil-like spool of string (11) would be pre-wound so that it is slightly smaller than the internal diameter of the shaft (12). The opening (17) in nock (15) and opening (18) in the shaft (12) would be pre-formed and wax or some other compound would typically be placed on the end (19) of the string of spool (11) to stiffen it so that when the spool (11) is dropped into the shaft (12), the end (19) of the string will extend through the openings (17) and (18). After the spool (11) has been inserted, the insert (14) is glued into the other end of the shaft (12) so that the broadhead (16) can be threadably engaged into the insert (14), for example, as shown in FIG. 3 and 4.

The catching device (20) can then be snapped onto the end of the shaft (12), for example, in the position shown in FIGS. 1 and 3, so that a friction fit is formed between the catching device (20) and the shaft (12). The catching device (20) is preferrably formed of a springy wire material, for example, of the type that fish hooks are constructed. Then the end of the line (19), sticking out through the openings (17) and (18), would be pulled around and tied to a loop (21) on one side of the catching device (20). Then in order to tighten the string (19) to the position shown in FIG. 1, the catching device (20) would be slid to the left as viewed in FIG. 1 or toward the broadhead (16).

In order to use the apparatus (10), it would merely be shot at a game animal or bird as in the case of any other hunting arrow. Once the broadhead (16) enters the animal or bird and the catching device (20) contacts the animal or bird, the catching device (20) will snap off of the shaft (12), because of the forwardly extending hooks (22) emanating from the arc-shape portion (23). If the arrow shaft (12) goes completely through the animal or bird, then the hooking device (20) would be on one side of the animal or bird and the arrow would be on the ground on the other side thereof. When the animal or bird flees, the string (19) will pass out of the center of the spool (11) so that the string can be traced from the arrow shaft (12) to the animal where it has eventually expired. It is optional as to whether the end of the string of spool (11) inside of the shaft (12) is attached to the insert (14) or not. If it is not attached, that would prevent breakage of the string if the animal or bird pulls out all of the string from inside the shaft (12).

If it happens that the shaft (12) does not pass completely through the bird or animal, then the catching device (20) will dangle on the ground as the animal or bird flees with the arrow shaft (12) in it. The catching device will then catch on a weed, bush, tree, grass or the like very soon and the string will be pulled from inside of the arrow shaft (12) as the arrow stays with the animal or bird on its way through the woods. This will also permit easy tracking of the game along the string.

Figure 7:
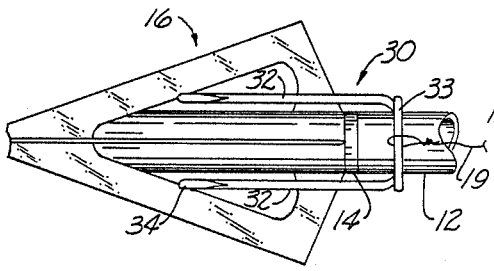
FIG. 7 is a view taken along line 7—7 of FIG. 6.
Figure 8:
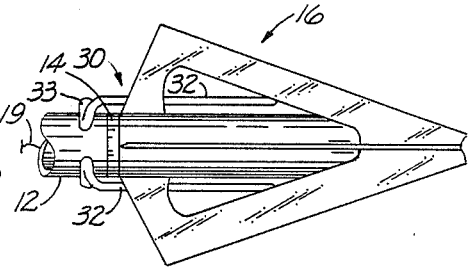
FIG. 8 is a view taken along line 8—8 of FIG. 6.

Referring now to FIGS. 6, 7 and 8, an alternate catching device (30) is shown snapped onto a shaft (12). The catching device (30) has an arcuate portion (33) and fish hook-like shanks (32) formed as an integral part thereof. The catching device (30) is preferably formed of a wire material similar to that used in making fish hooks so that it will hold onto the shaft (12) by friction, but when the end (34) strikes an object as shown schematically by object (35) shown in dashed lines in FIG. 6, the hooking device (30) will tip upwardly and snap off of the shaft (12). The hooking device (30) then can readily be substituted for the hooking device (20) in the combination shown in FIGS. 1 through 5 with very similar results; namely, that the hooking device (30) will stay on the shaft during its flight from the bow to the animal or bird, but once it strikes the animal or bird, it will pop off the shaft (12).

Accordingly, it will be appreciated that the embodiments shown herein will indeed accomplish the aforementioned objects. Obviously, many modifications and variations of the present invention are possible in light of the above teachings. It is therefore to be understood that, within the scope of the appended claims, the invention may be practiced otherwise than as specifically described.

We claim:

1. A string tracking apparatus for archery arrows comprising:
   - a hollow tubular shaft;
   - means for attaching a point to one end of said shaft;
   - nock means for receiving a string attached to the other end of said shaft, said shaft being adapted to have fletchings attached to said other end thereof;
   - flexible line disposed within said shaft between the one end and the other end of the shaft;
   - catching means attached to one end of said flexible line, said catching means being disposed on said one end of the shaft and having at least one end disposed outside of said shaft for catching onto an object when said arrow shaft penetrates said object; and
   - means operatively associated with said shaft to permit the flexible line to be pulled from the interior of the shaft by a force pulling on said catching means.

2. The apparatus of claim 1 wherein said catching means comprises:
   - a spring clip having two ends and extending around more than 180° of the exterior of said shaft and in frictional engagement with said shaft; and
   - hook means attached to at least one of said ends, said hook means extending forwardly of said shaft from said spring clip so when the arrow shaft penetrates an object, the hook means will contact the object before said spring clip contacts said object, thereby causing said spring clip and hook to become disengaged from said shaft upon contact with said object.

3. The apparatus of claim 1 wherein said catching means comprises:
   - a hook;
   - means for attaching said hook to the exterior of said shaft; and
   - means for causing said hook to become disengaged from said shaft upon contact with an object into which the shaft enters.

4. The apparatus of claim 3 wherein the hook has the line operatively attached to a first end thereof and has a free end at the other end thereof and an arcuate portion between said first end and said free end, said free end of the hook pointing back generally in the direction toward said first end thereof, whereby the arcuate portion will be in front of said free end during the flight of the arrow shaft.

5. A string tracking apparatus for archery arrows comprising:

a hollow tubular shaft;

means for attaching a point to one end of said shaft;

nock means for receiving a string attached to the other end of said shaft, said shaft being adapted to have fletchings attached to said other end thereof;

an opening leading from the interior to the exterior of said shaft;

flexible line disposed within said shaft between the one end and the other end of said shaft; and catching means attached to one end of said flexible line, said catching means being disposed adjacent to said one end of the shaft and having at least one end disposed outside of said shaft for catching onto an object when said arrow shaft penetrates said object whereby the flexible line will be pulled from the interior of the shaft by a force pulling on said catching means.

* * * * *